US006540166B2

(12) United States Patent
Frick

(10) Patent No.: US 6,540,166 B2
(45) Date of Patent: Apr. 1, 2003

(54) MOBILE CRUSHER DEVICE AND METHOD OF TRANSPORTING THE DEVICE

(76) Inventor: Dietmar Frick, Nägele 3, A-6842 Koblach (AT)

( * ) Notice: Subject to any disclaimer, the term of this patent is extended or adjusted under 35 U.S.C. 154(b) by 0 days.

(21) Appl. No.: 09/774,244

(22) Filed: Jan. 30, 2001

(65) Prior Publication Data

US 2001/0020656 A1 Sep. 13, 2001

(30) Foreign Application Priority Data

Jan. 31, 2000 (AT) ..... 141/00

(51) Int. Cl.[7] ..... B02C 21/02
(52) U.S. Cl. ..... 241/101.76
(58) Field of Search ..... 241/101.71, 101.75, 241/101.76, 101.761, 101.762, 101.763, 101.77

(56) References Cited

U.S. PATENT DOCUMENTS 5,294,065 A * 3/1994 Harms ..... 241/101.76
5,460,332 A 10/1995 Frick

FOREIGN PATENT DOCUMENTS

| | | |
|---|---|---|
| DE | 198 05 378 A1 | 8/1999 |
| EP | 0547440 | 6/1993 |
| EP | 0923991 | 6/1999 |
| WO | 9949976 | 10/1999 |

* cited by examiner

*Primary Examiner*—Mark Rosenbaum
(74) *Attorney, Agent, or Firm*—Friedrich Kueffner

(57) ABSTRACT

A mobile crusher device has a track-laying chassis having drive wheels and tracks guided about the drive wheels. A frame is supported on the chassis. A crusher tool is connected to the frame. A drive apparatus for driving the crusher tool is connected to the frame. A conveyor belt for transporting material crushed by the crusher tool away from the crusher tool is connected to the frame. The frame has a horizontal pivot axis extending parallel to the axes of the drive wheels. The frame is pivotable about the pivot axis together with the crusher tool, the drive apparatus, and the conveyor belt connected to the frame. A semitrailer kingpin arrangement is connected to the frame on a first side of the frame. A fastening device for fastening a trolley to the mobile crusher device is connected to a second side of the frame opposite the first side.

12 Claims, 4 Drawing Sheets

MOBILE CRUSHER DEVICE AND METHOD OF TRANSPORTING THE DEVICE

BACKGROUND OF THE INVENTION

1. Field of the Invention

The invention relates to a mobile crusher device with a track-laying chassis, a frame supported on the track-laying chassis, on which a motor-operated crusher tool, for example, in the form of crusher plates arranged in pairs in a substantially upright arrangement and swinging against one another, and at least one drive apparatus for the crusher tool are provided, and with a conveyor belt for transporting the crushed material away, wherein the frame as a whole and with the devices supported thereon is pivotable about a horizontal axis which is parallel to the axes of the wheels of the track-laying chassis. Moreover, the invention relates to a method for transporting such a crusher device.

2. Description of the Related Art

Such a mobile crusher device is known from European patent application 0 923 991 A1. The pivotability of the frame relative to the track-laying chassis in this device is provided in order to lift the frame and to make accessible the high-stress machine parts of the crusher device subjected to considerable wear, for example, the conveyor belt, directly from below to the mounting and service personnel. The mounting and service labor can therefore be carried out with considerable time savings in comparison to known devices.

Mobile crusher devices with track-laying chassis are extremely large and heavy. At the respective site of use, they are movable by their track-laying chassis. However, these track-laying chassis are not suitable for transportation on roads. Crusher devices of this kind are therefore conventionally transported within public traffic areas on low-bed semitrailer trucks with special permits and accompanied by escort vehicles. Such a transportation stresses the traffic areas not only by the enormous weight of the crusher device itself but also by the great weight of the low-bed semitrailer trucks that are being used.

In European patent application 0 547 440 B1 measures have already been proposed to configure a crusher device with a track-laying chassis such that it can be transported in public traffic areas without low-bed semitrailer trucks. For this purpose, on opposite sides of the frame, relative to the track-laying chassis, a feed hopper for the material to be crushed is pivotably arranged by means of a first piston-cylinder unit and, opposite thereto, a pivotable frame for the conveyor belt is pivotably arranged by means of a second piston-cylinder unit. A kingpin of a semitrailer coupling is provided on the underside of the pivotable feed hopper, and bearing plates for connecting a trolley are arranged on the underside of the pivotable frame for the conveyor belt. By lowering the pivotable frame for the conveyor belt, a trolley having preferably three axles can be connected to the bearing plates. Subsequently, the kingpin is lowered by pivoting the feed hopper onto the semitrailer coupling of a semitrailer tractor and inserted into it. By further loading the two aforementioned piston-cylinder units, the central part of the mobile crusher device is lifted so that the track-laying chassis is positioned above the ground. Now the crusher device can be transported like a semitrailer truck.

Even though this type of transportation of the crusher device provides a significant improvement in comparison to the transportation of the known crusher devices by means of a low-bed semitrailer truck, the configuration of the feed hopper and of the frame of the conveyor belt so as to be pivotable by piston-cylinder units, requiring that these parts must be designed to be correspondingly strong, results in a considerable construction expenditure.

SUMMARY OF THE INVENTION

It is an object of the present invention to allow the mobile crusher device to be transported like a semitrailer truck and to provide, in comparison to the crusher device of European patent application 0 547 440 B1, a simplified configuration.

In accordance with the present invention, this is achieved for a crusher device of the aforementioned kind in that on the frame, on opposite sides of the frame relative to the track-laying chassis, a kingpin of a semitrailer coupling, respectively, a support member of a kingpin is arranged on one side and a device, preferably in the form of bearing plates, for fastening a trolley, is arranged on the other side. The method according to the invention is characterized in that: in a first step, the piston-cylinder unit is moved somewhat relative to the completely retracted initial position wherein a fastening device for fastening a trolley, positioned on the side of the frame opposite the piston cylinder unit relative to the track-laying chassis and formed preferably by bearing plates, is lowered, and a trolley is connected to this device; in a further step, the piston-cylinder unit is extended farther, wherein the part of the track-laying chassis adjacent to the trolley is lifted and, at the same time, a kingpin of a semitrailer coupling, located at the same side of the frame as the piston-cylinder unit relative to the track-laying chassis, is lifted; and, in a further step, the semitrailer tractor is moved underneath the kingpin and the piston-cylinder unit is again retracted so that the track-laying chassis is completely lifted off the ground.

The principle of the invention thus resides in that it is possible, by means of the measures according to the invention, to realize a transportation in the way of a semitrailer truck for a pivotable configuration of the frame with the advantages mentioned in European patent application 0 923 911 A1, but without having to provide further pivotable parts of the kind disclosed in European patent application 0 547 440 B1. Accordingly, smaller and more lightweight crusher devices than those described in European patent application 0 547 440 B1 can be produced in an inexpensive way so as to be transportable like a semitrailer truck, and there is still a considerable simplification provided relative to the transportation on a low-bed semitrailer truck. For example, the crusher device according to the invention can have a weight in the area of approximately 30 metric tons.

Preferably, the kingpin is supported by a kingpin support member which is pivotably connected by bearing plates to the frame. The kingpin support member is supported by one or more links in its working position during transportation. During operation of the crusher device at the respective site of use, the links can be removed and the kingpin support member can be tilted upwardly and placed against the frame so that the space requirement of the crusher device is reduced.

A crusher device with a track-laying chassis, which can be transported by means of a trolley and a semitrailer tractor on public traffic areas, is already known from WO 99/49976. Piston-cylinder units are provided for lifting the crusher device. As a result, a trolley can be moved underneath the crusher device and can be connected to the crusher device by means of bearing plates. On the side opposite the track-laying chassis a kingpin of a semitrailer coupling is provided which is connected with the coupling plate of the semitrailer coupling of a semitrailer tractor. A disadvantage of this device is that, after lifting of the crusher device by means of the piston-cylinder units, the crusher device is no longer movable. Accordingly, the trolley must be moved. However, especially in the case of uneven and unpaved surfaces, as is usually the case at locations of use of such crusher devices, this is not easily possible. Moreover, after moving the trolley under the crusher device, the height of the bearing plates must be adjusted by a corresponding adjustment of the piston-cylinder units in order to make possible the connection with the trolley. The process of coupling the trolley to the crusher device is thus relatively complicated, and additional piston-cylinder units are required for lifting the crusher device.

Further advantages and details of the invention will be explained in the following with the aid of the embodiment illustrated in the attached drawing.

DESCRIPTION OF THE PREFERRED EMBODIMENTS

Figure 1:
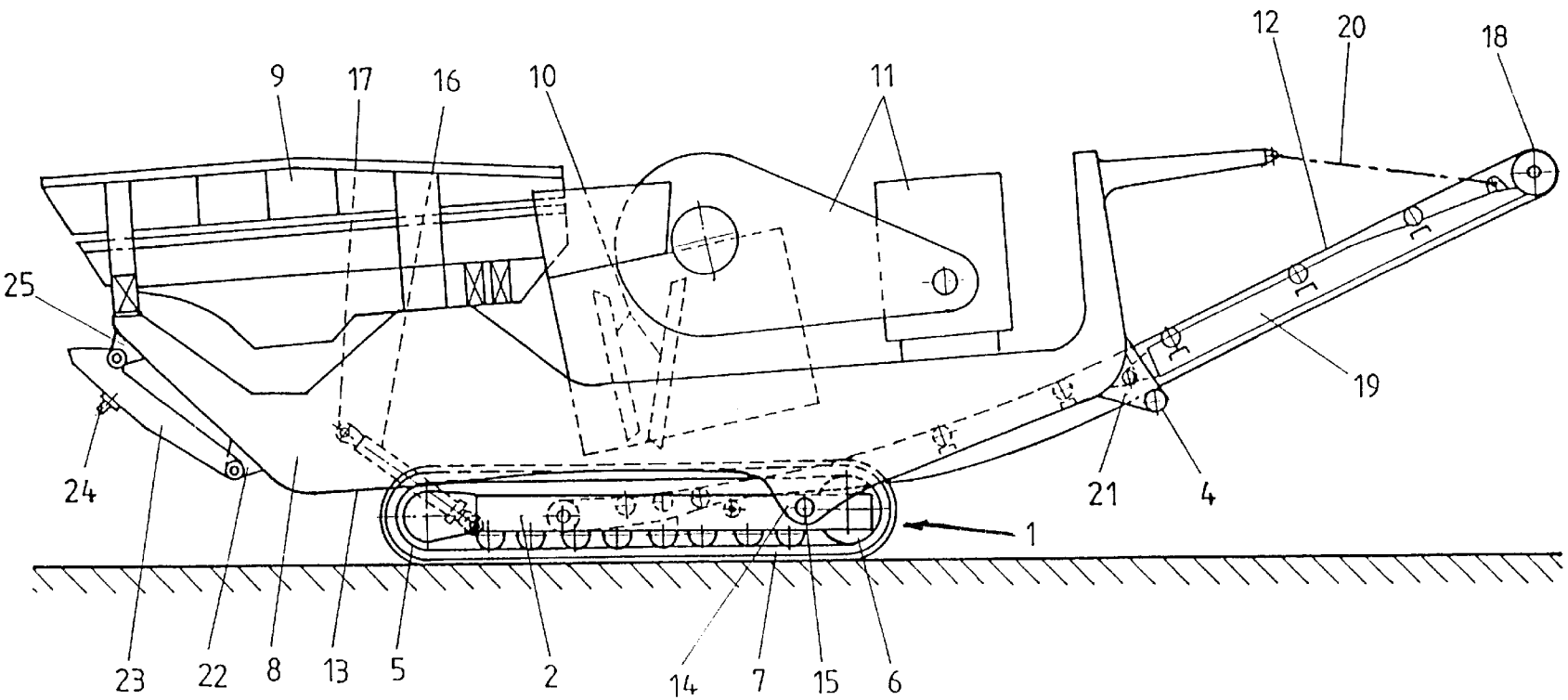
FIG. 1 shows in a simplified illustration a side view of the mobile crusher device according to the invention in an operating position.

The crusher device has a track-laying chassis 1 which has two frame parts 2 spaced apart from one another, which, viewed at a right angle to the plane of FIGS. 1 through 4, are positioned behind one another. These two frame parts 2 are connected to one another by transverse beams. At the end faces of the two frame parts 2 deflection or drive wheels 5 and 6 are provided, respectively, about which the track 7 is guided.

This track-laying chassis 1 supports a frame 8 with a feed hopper 9, with crusher plates 10, and a drive apparatus 11 for the operation of the crusher plates 10. Furthermore, a conveyor belt 12 is provided which is also connected to the frame 8 and whose material-receiving end extends under the frame 8, preferably to a point under the crusher plates 10. The crusher plates 10 are essentially upright. One of the two plates of the crusher tool is supported stationarily on the frame 8, the other plate carries out swinging movements so that this plate is periodically moved back and forth relative to the stationary plate. Such a crusher tool is known and therefore must not be disclosed in more detail at this point. The use of any other known crusher tool, for example, an impact crusher mill, is also possible.

Below the feed hopper 9, and also partially underneath the drive apparatus 11, the frame 8 is limited in the downward direction by a substantially straight contour 13 which at the side facing away from the feed hopper 9 extends downwardly for the purpose of forming bearing plates and thus forms a type of bracket or plate 14. In the operating position of the crusher device, this straight contour 13 is substantially horizontal (FIG. 1) and above the track-laying chassis 1.

The downwardly extending bracket 14 of the frame 8 is secured on the track-laying chassis 1 such that the frame 8 has a whole can be pivoted about the pivot axis 15 with all of the devices supported on it. This pivot axis 15 is thus positioned within the track-laying chassis 1 having the two frame parts 2. The pivot axis 15 is positioned close to one of the deflection or drive wheels 6.

At the side of the frame 8 facing away from the pivot axis 15, a piston-cylinder unit 16 is provided which is positioned between the two frames 2 of the track-laying chassis 1 and whose one end 17 is secured on the frame 8. The connecting point of the piston-cylinder unit 16 on the frame 8 is laterally positioned relative to the track-laying chassis 1, i.e., relative to its steering axis. The frame 8 projects on both sides past the track-laying chassis 1.

The connecting point of the piston-cylinder unit 16 on the track-laying chassis 1 is positioned below an imaginary horizontal plane which includes the axes of the deflection or drive wheels 5, 6 of the track-laying chassis 1.

The feed hopper 9 and the dumping end 18 of the conveyor belt, relative to the track-laying chassis, are positioned on opposite sides of the frame 8. The portion of the conveyor belt 12 adjacent to the dumping end 18 is supported by a frame 19 which is pivotably supported on the frame 8. By means of a tension cable 20, the height of the dumping end can be changed by pivoting the frame 19 relative to the frame 8.

At the side of the track-laying chassis 1 on which the frame 19 of the conveyor belt 12 is supported on the frame 8, two bearing plates 21 are fastened to the underside of the frame 8 and are positioned, viewed at a right angle to the plane of the drawing, behind one another. These bearing plates 21 serve to connect the trolley 26 to the frame 8 as will be explained in more detail infra. On the opposite side of the frame 8, relative to the track-laying chassis, a king pin arrangement with a kingpin support member 23 and kingpin 24 is connected to the frame 8 by bearing plates 22 secured on the frame 8. The support member 23 supports a kingpin 24 of a semitrailer coupling. In the operating position illustrated in FIG. 1, the support member 23 is pivoted upwardly and is secured by bearing plates 25 in this position.

Figure 2:
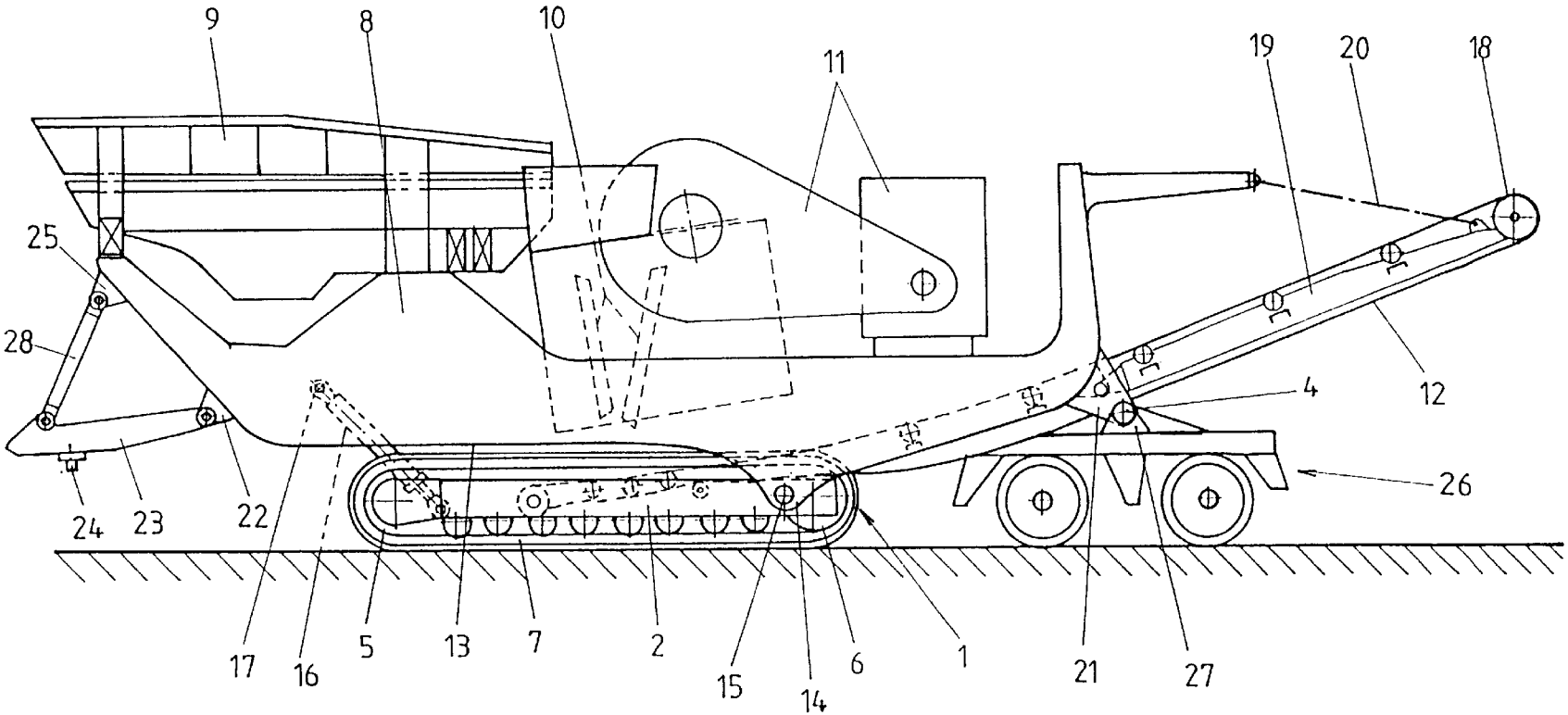
FIG. 2 shows in a simplified illustration a side view of the mobile crusher device of FIG. 1 in the position in which the trolley is connectable to the frame.

In the position illustrated in FIG. 2, the piston-cylinder unit 16, in comparison to FIG. 1, is slightly farther extended wherein the bearing plates 21 are slightly lowered and in this position can be connected to an axle apparatus or trolley 26 having been positioned under the bearing plates previously. For this purpose, the trolley 26 has bearing plates 27 also arranged in pairs which can be connected by means of axial bolts or axial shafts with the bearing plates 21.

Moreover, in FIG. 2 the plate 23 is in a downwardly pivoted position and is secured in this position by two links 28 which, viewed at a right angle to the plane of the drawing, are arranged behind one another. Instead of the links 28 a piston-cylinder unit could also be used for an automatic adjustment of the plate 23. In this downwardly pivoted position of the plate 23, the kingpin 24 points substantially vertically downwardly.

Figure 3:
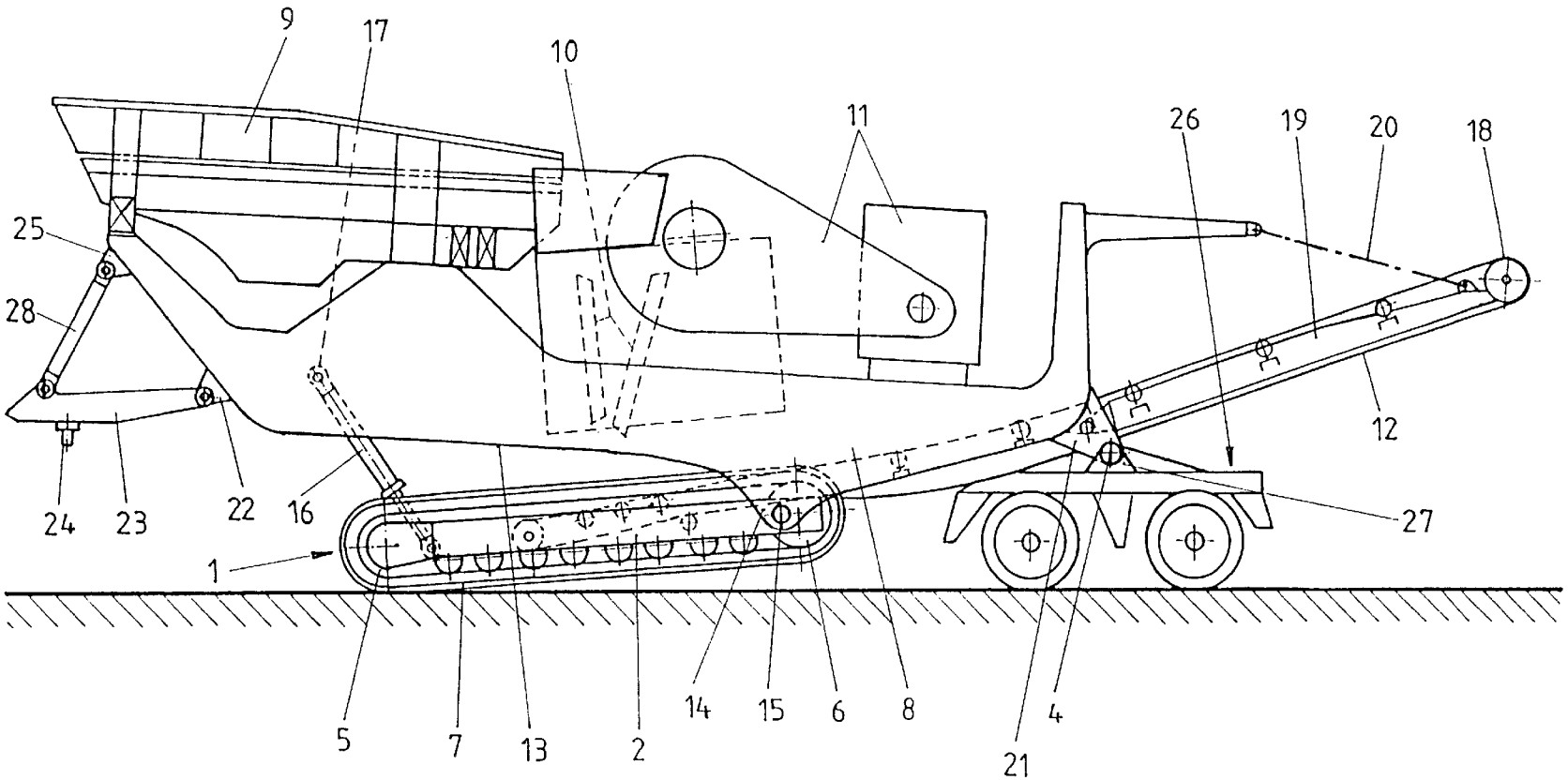
FIG. 3 shows in a simplified illustration a side view of the mobile crusher device according to FIG. 1 with lifted kingpin.
Figure 4:
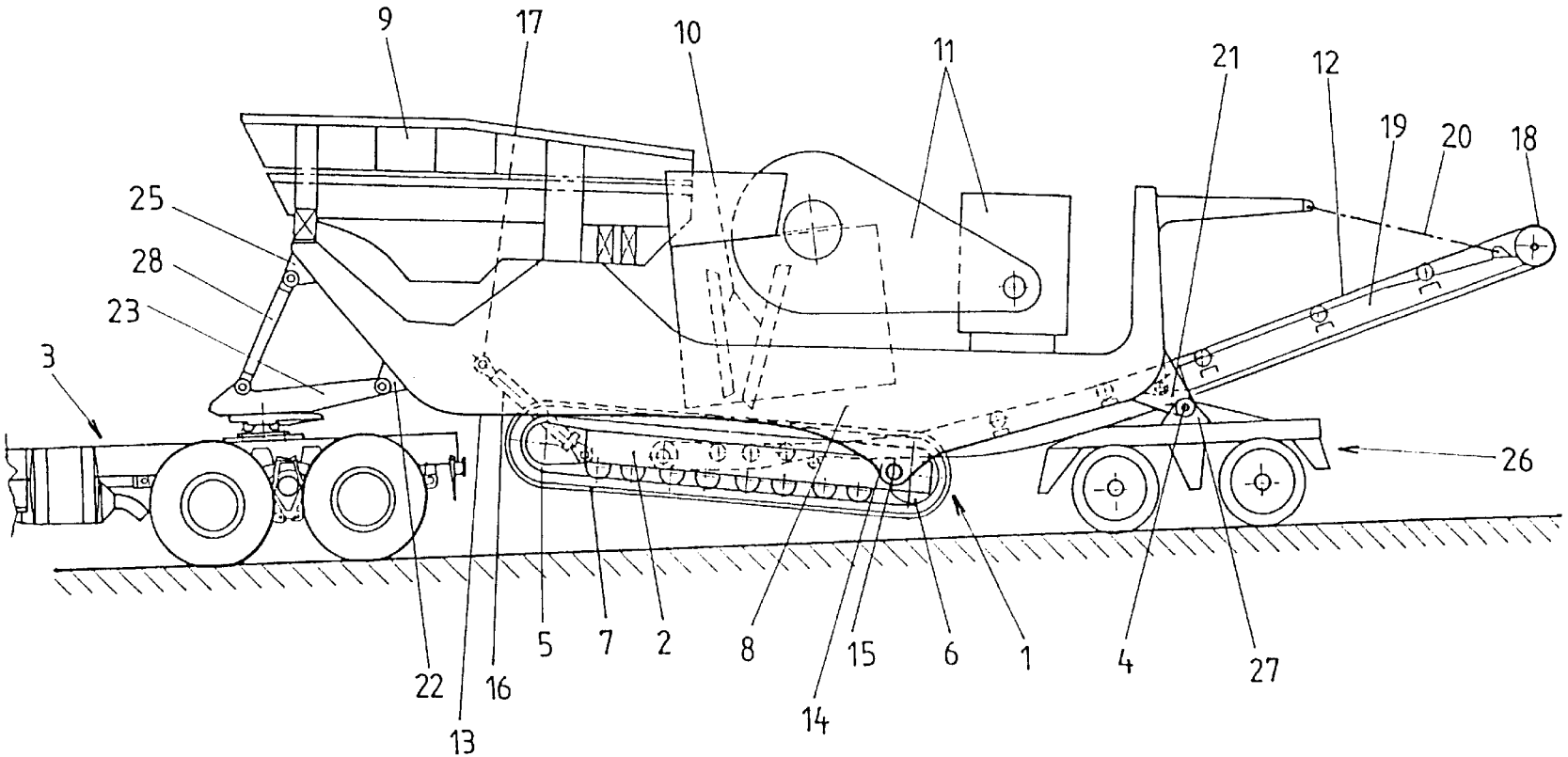
FIG. 4 shows in a simplified illustration a side view of the mobile crusher device in the transport position.

In the position illustrated in FIG. 3, the piston-cylinder unit 16 is extended farther relative to FIG. 2. Accordingly, the frame 8 is lifted by the piston-cylinder unit 16 and, since the bearing plates 21 rests on the trolley 26, the part of the track-laying chassis 1 adjacent to the trolley 26 is lifted. In this position, a semitrailer tractor 3 can be moved under the kingpin 24 so that the coupling plate of the semitrailer coupling is positioned underneath the kingpin 24. Subsequently, the piston-cylinder unit 16 is again retracted. This has the result that first the kingpin 24 is lowered and inserted into the semitrailer coupling. By a further retraction of the piston-cylinder unit 16, the end of the track-laying chassis 1 neighboring the kingpin 24 is now also lifted so that the track-laying chassis 1 is positioned completely above the ground (see FIG. 4). Now the crushing device can be transported like a semitrailer truck.

A crusher device illustrated in FIGS. 1 through 4 has a weight in the range of 30 metric tons. A weight of approximately 15 to 16 metric tons thus rests on the trolley 26 so that it is favorably provided with at least two axles. Instead of the bearing plates 21 other devices for attachment of the trolley 26 on the frame 8 can be provided, for example, a kingpin which can be brought into engagement with a coupling plate of a semitrailer coupling arranged on the trolley 26. The connecting point 4 of the trolley 26 on the frame 8 has advantageously a spacing of at least 2.5 meters, preferably at least 2.8 meters. In any case, the connecting point 4 of the trolley on the frame 8 must have such a great spacing from the pivot axis 15 of the frame that a sufficient pivot range can be covered. This pivot range or pivot stroke comprises, on the one hand, the travel between the operating position and the position of connection of the trolley and also the pivot travel between the connected trolley (FIG. 2) and the position in which the part of the track-laying chassis adjacent to the trolley is lifted sufficiently off the ground (FIG. 3). In an analogous manner, the kingpin must perform a sufficient pivot stroke when the frame 8 is pivoted by means of the piston-cylinder unit 16 in order to be lifted, on the one hand, above the semitrailer coupling of the semitrailer tractor and to be lowered into it, and, on the other hand, to allow a sufficient lifting of the part of the track-laying chassis adjacent to the semitrailer coupling off the ground.

Basically, it is also conceivable and possible to exchange the arrangement of the bearing plates 21 and of the kingpin 24 on the frame 8, wherein the dumping end 18 of the conveyor belt 12 then extends above the semitrailer tractor 3.

In the operating position illustrated in FIG. 1, the frame 8 can be pivoted by the piston-cylinder unit 16 about the pivot axis 15 in a manner known in the art in the upward direction in order to make the high-stress machine parts, which are subjected to considerable wear, directly accessible from below for service and mounting labor (compare European patent application 0 923 991 A1).

Basically, it would also be conceivable and possible to keep the trolley 26 in the operating position according to FIG. 1 connected to the bearing plates 21 so that it would be lifted off the ground.

While specific embodiments of the invention have been shown and described in detail to illustrate the inventive principles, it will be understood that the invention may be embodied otherwise without departing from such principles.

What is claimed is:

1. A mobile crusher device comprising:

a track-laying chassis having drive wheels and tracks guided about the drive wheels;

a frame supported on the chassis;

a crusher tool connected to the frame;

a drive apparatus configured to drive the crusher tool and connected to the frame;

a conveyor belt, configured to transport material crushed by the crusher tool away from the crusher tool, connected to the frame;

the frame having a horizontal pivot axis extending parallel to the axes of the drive wheels, wherein the frame is pivotable about the pivot axis together with the crusher tool, the drive apparatus, and the conveyor belt connected to the frame;

a semitrailer kingpin arrangement connected to the frame on a first side of the frame;

a fastening device, configured to fasten a trolley to the mobile crusher device, connected to a second side of the frame opposite the first side.

2. The mobile crusher device according to claim 1, wherein the crusher tool comprises a pair of substantially vertical crusher plates configured to swing toward one another.

3. The mobile crusher device according to claim 1, wherein the kingpin arrangement comprises a kingpin.

4. The mobile crusher device according to claim 1, wherein the kingpin arrangement comprises a kingpin support member.

5. The mobile crusher device according to claim 1, wherein the fastening device comprises bearing plates.

6. The mobile crusher device according to claim 1, wherein the kingpin arrangement comprises a kingpin support member, pivotably connected to the frame; a kingpin connected to the kingpin support member; and at least one support link or piston-cylinder unit supporting the kingpin support member in a working position during transport.

7. The mobile crusher device according to claim 1, further comprising a feed hopper connected to the frame, wherein the feed hopper is located at the first side of the frame.

8. The mobile crusher device according to claim 1, wherein the conveyor belt has a dumping end located at the second side of the frame.

9. The mobile crusher device according to claim 1, wherein the trolley has two axles.

10. The mobile crusher device according to claim 1, wherein the fastening device has an attachment point for the trolley and wherein the attachment point and the horizontal pivot axis are spaced from one another by a distance of at least 2.5 m.

11. The mobile crusher device according to claim 10, wherein the distance is at least 2.8 m.

12. The mobile crusher device according to claim 1, wherein the kingpin arrangement and the fastening device are located at opposite ends of the track-laying chassis in a travel direction of the track-laying chassis.

* * * * *